United States Patent [19]

Turner

[11] 4,424,652

[45] Jan. 10, 1984

[54] PRE-CAMBERED STEEL BEAM

[76] Inventor: Arthur R. Turner, 29 Healey Rd., Dandemong, Victoria, Australia

[21] Appl. No.: 202,629

[22] Filed: Oct. 31, 1980

[51] Int. Cl.[3] ..... E04B 1/26; E06B 1/04

[52] U.S. Cl. ..... 52/204; 52/639; 52/729

[58] Field of Search ..... 52/84, 86, 88, 223 R, 52/204, 225, 226, 639, 640, 729, 732, 657,

[56] References Cited

U.S. PATENT DOCUMENTS

| | | | |
|---|---|---|---|
| 542,283 | 7/1895 | Rousseau | 52/729 |
| 768,594 | 8/1904 | Finlay | 52/86 |
| 1,335,609 | 3/1920 | Schneller | 52/84 |
| 2,039,398 | 5/1936 | Dye | 52/223 R |
| 2,389,573 | 11/1945 | Balduf | 52/657 |
| 2,916,111 | 12/1959 | Pleitgen et al. | 52/640 |
| 2,986,246 | 5/1961 | Lester | 52/640 |
| 3,101,272 | 8/1963 | Setzer | 52/640 |
| 3,294,608 | 12/1966 | Peterson | 52/223 R |
| 3,300,839 | 1/1967 | Lichti | 52/640 |

FOREIGN PATENT DOCUMENTS

| | | | |
|---|---|---|---|
| 164961 | 9/1955 | Australia | 52/225 |
| 1048852 | 8/1953 | France | 52/729 |

*Primary Examiner*—James L. Ridgill, Jr.

*Attorney, Agent, or Firm*—Blakely, Sokoloff, Taylor & Zafman

[57] ABSTRACT

A precambered roll formed metal structural beam and method of making same. The precambered beam may be used in wood frame constructions to replace large and increasingly expensive wooden header beams, or it may be used in steel beam structures and framework where the precambering permits use of lighter beams without resulting in undesirable visible sagging. The beams maybe fabricated in various cross sections and with an amount of precamber tailored to a specific job.

22 Claims, 24 Drawing Figures

Fig. 7
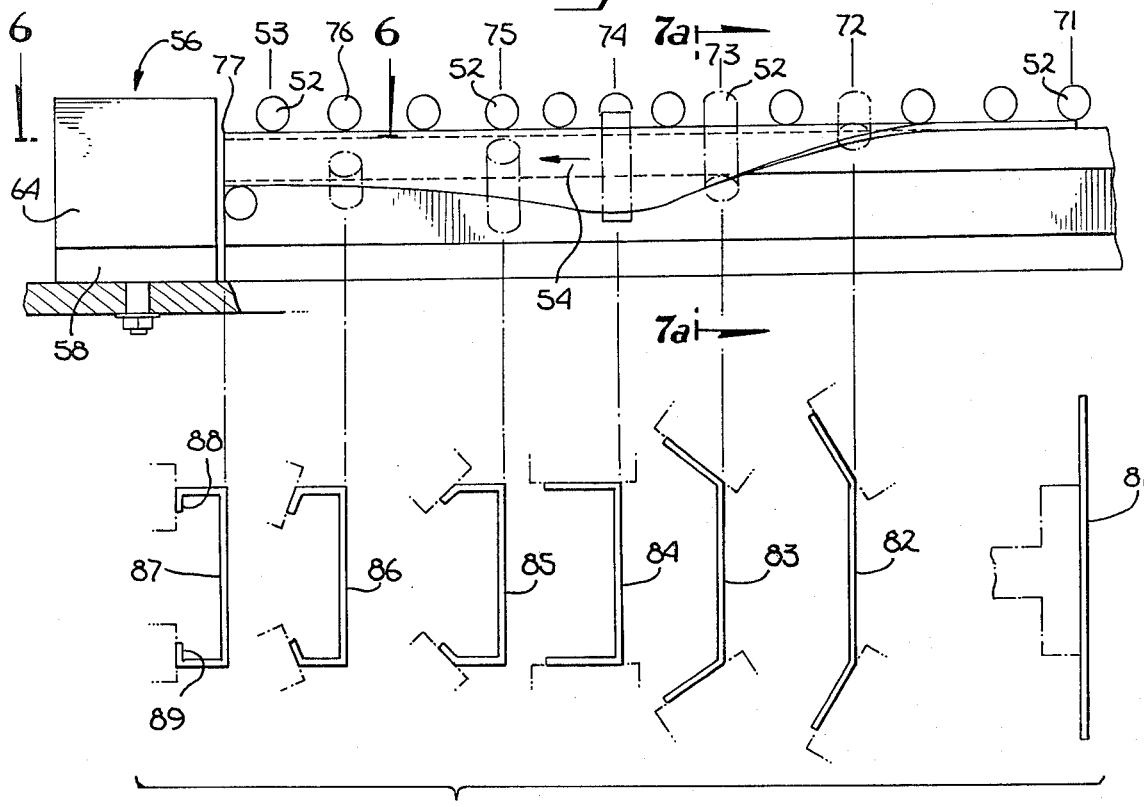
Fig. 8
Fig. 7a
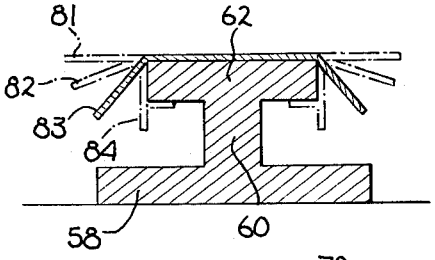
Fig. 6a
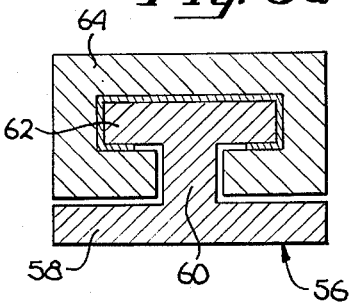
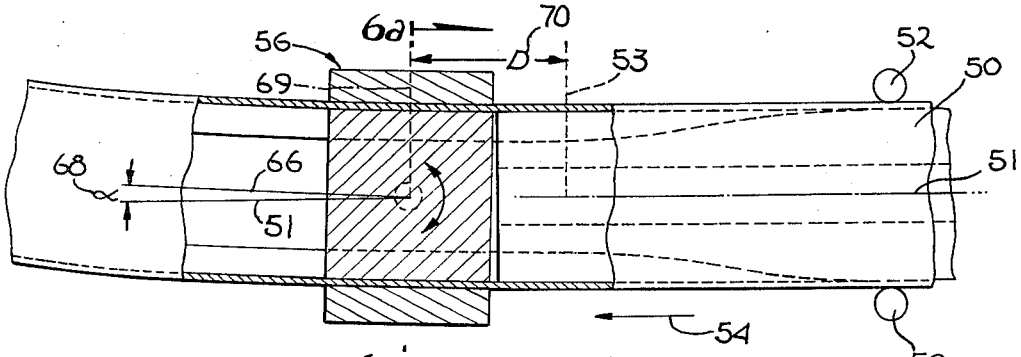
Fig. 6

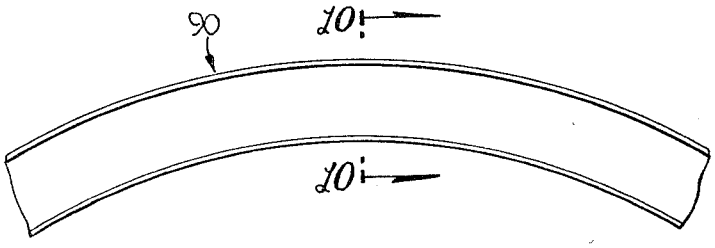
Fig. 9
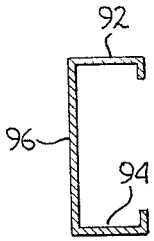
Fig. 10
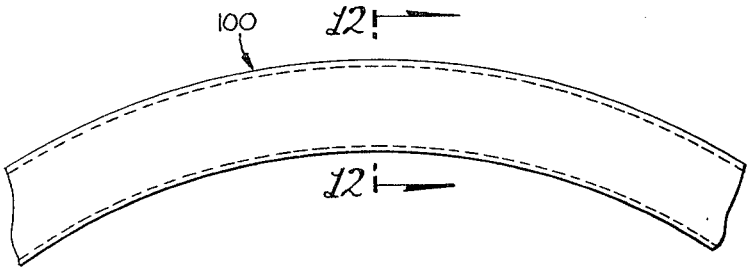
Fig. 11
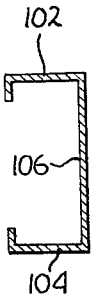
Fig. 12
Fig. 13
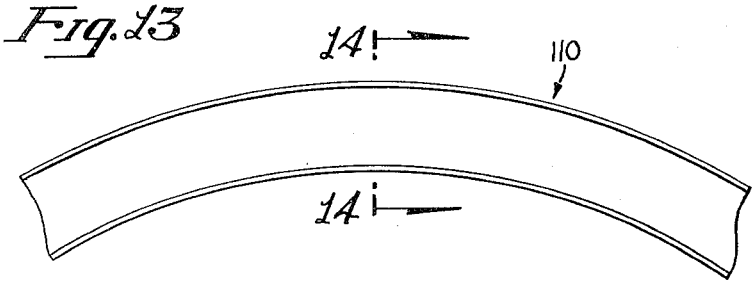
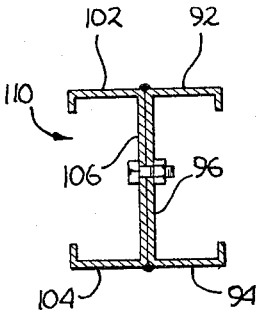
Fig. 14
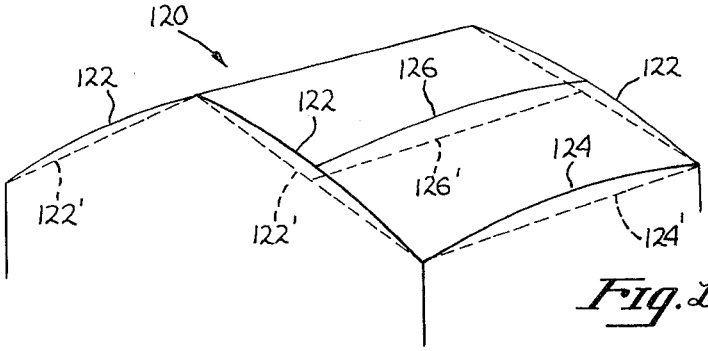
Fig. 15

PRE-CAMBERED STEEL BEAM

BACKGROUND OF THE INVENTION

1. Field of the Invention

This invention relates to structural beam members and particularly to pre-cambered roll formed beam members.

2. Prior Art

The advantages of certain forms of cambered and prestressed beams have been recognized in the construction industry for many years. Depending upon the particular use to which a beam is put, it may take various shapes and be formed in various ways. Illustrative of such beams, their form and formation are U.S. Pat. Nos. 3,300,839 to R. D. Lichti; 2,986,246 to R. W. Lester; and 3,010,272 to G. W. Setzer.

Lichti shows a method of making beams in which a camber is imparted to an I or H beam during its construction. The upper and lower flanges and the center corregated web member of the I beam are held in a curved position by a jig assembly and welded together.

Setzer discloses a method for improving structural members, such as beams, in which the structural members are pre-loaded by permanently imparting reverse loads to the members to resist the loads which are to be imposed in use. The member is improved by adding welding metal to the top flange, the bottom flange or both, in areas where the pre-load is desired. For example, welding metal is applied along the central portion of the lower flange of the beam, as shown in FIGS. 1 and 5 (see elements 4 and 14 respectively). The metal is applied by a conventional welding operation which causes some heating of the beam in and adjacent the area where the molten welding material is laid. The degree of heating of the beam, however, is much less than the heat of the molten welding material and, consequently, the welding metal will shrink in cooling to a greater degree than the beam. As the welding metal commonly used has a greater tensile strength than the metal of the beam, the shrinking welding material will draw the material of the beam with it, so that the portion of the beam beneath the welding material will be placed in compression. By proper placement and spacing of a number of such areas of welding material (e.g., as at 5 in FIG. 1) the beam may be cambered slightly at its ends and thereby "preloaded." This preloading may be applied to beams, columns, trusses, etc.

Lester discloses a preloaded, prestressed beam structure. However, the prestressing procedure is applied at the time of, or following, installation, not as part of the manufacturing process of the beam. Moreover, to cause the cambering, external devices are required to deform the beam (e.g., the screw-adjustable prestressing members 26 and 28 and a pair of screw adjustable preloading members 30 and 32).

SUMMARY OF THE INVENTION

The invention comprises a pre-cambered roll-formed metal structural beam member, which can be used in place of the large and expensive wood beams now used as header beams in the wood frame construction of windows and other openings in walls and the method for making same. In one particular embodiment, a flange of the pre-cambered beam sits between the two plates formimg the top of a wall of wood frame construction. The two plates are curved slightly during construction to conform to the curvature of the pre-cambered beam. In another embodiment the pre-cambered beam may have a second flange for insertion into a plurality of saw kerfs provided at a preselected distance down from the top of each of a plurality of cripple studs. The kerfs are aligned in a curved pattern, conforming to the pre-camber of the beam, by bending of the top plates. The same method used to form these beams may also be used to form pre-cambered beams useful in steel (or other metal) frame construction.

The pre-cambered beams may be formed to their final cross section by a cold rolling process in which a roll of flat sheet steel is progressively shaped, by a series of form rollers, to conform to the shape of a male mold. After the beam has been given its final cross-sectional shape, it is passed through a final adjustable deflection guide having the same cross-section as the beam, but which has its longitudinal axis positioned at an adjustable angle to the centerline of the beam as it passes through the series of form rollers. Adjustment of the degree of camber is accomplished by adjusting the angle between the centerlines and the distance between the final form roller and the adjustable deflection guide.

BRIEF DESCRIPTION OF THE DRAWINGS

FIG. 6 is a top view of the apparatus used to form the pre-cambered beam.

FIG. 6*a* is a cross section of the deflection guide taken along the line 6*a*—6*a* of FIG. 6.

FIG. 7 is a side view of the apparatus of FIG. 6.

FIG. 7*a* is a cross-section taken along the line 7*a*—7*a* of FIG. 7.

FIG. 8 illustrates the progressive change of shape in cross section of the steel sheet.

FIG. 9 shows a beam pre-cambered in a first direction.

FIG. 10 is a cross-section of beam of FIG. 9.

FIG. 11 shows a beam pre-cambered in the direction opposite that shown in FIG. 9.

FIG. 12 is a cross-section of the beam of FIG. 11.

FIG. 13 illustrates the formation of the pre-cambered I beam using the beams of FIGS. 9 and 11.

FIG. 14 is a cross-section of the I beam of FIG. 13.

FIG. 15 illustrates an alternate use of the pre-cambered beam.

DETAILED DESCRIPTION OF THE INVENTION

Figure 1:
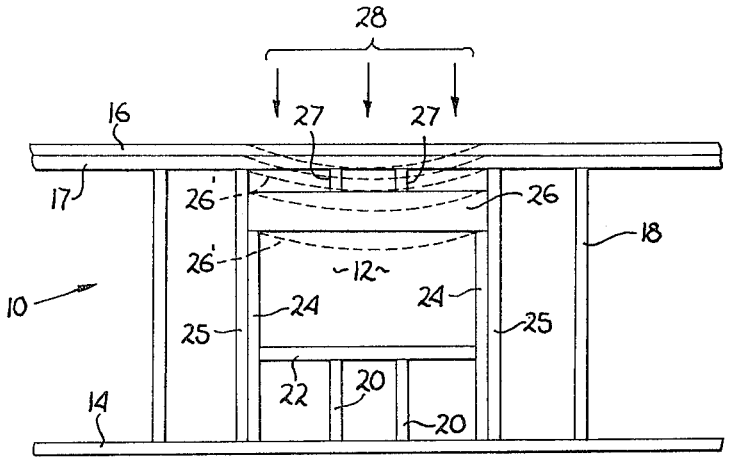
PRIOR ART Fig. 1
FIG. 1 illustrates the prior art use of large wood beams as headers in wood frame construction.

A typical section of a wall 10 with a window opening 12 using prior art wood frame construction techniques is shown in FIG. 1. The wall has a bottom plate 14 connected to top plates 16 and 17 by studs such as 18. The bottom of the window opening 12 is formed by a plurality of cripple studs 20, which are capped by a sill 22. The sides of the window opening 12 are formed by jack studs 24 and king studs 25. The top of the window opening 12 is formed by a header beam 26 which rests upon the top ends of jack studs 24 and lies beneath the plate 17 and is coupled thereto by cripple studs 27.

Such a wall structure is only a small portion of a larger structure or building which typically would have a roof and other construction above the level of plates 16 and 17. As shown in FIG. 1, there is no loading on the plates 16, and 17 and header 26. As construction progresses on the structure, however, the weight of the additional construction causes a loading indicated by arrows 28 in the downward direction upon the plates 16, 17 and header 26. Such loading will, over a period of time, cause sagging in the plates 16, 17 and in the header 26 in an amount directly related to the amount of loading as indicated by the arrows 28. With a wooden header 26, the sagging does not all appear immediately upon completion of construction, but will subsequently appear over an extended length of time. Eventually, the amount of sagging will be approximately, in a typical situation, one millimeter per foot of span of the header 26. For a six-foot window opening, this would mean 6 millimeters, or approximately $\frac{1}{4}$ inch of sag in the header 26. A sag of this magnitude will be visibly apparent, and may cause problems in the free movement of windows, which may be located within the window opening 12. For purposes of illustration, the sag of the wooden header 26 is indicated by the dashed lines 26'. The displacement of the sagged header 26' is, of course, exaggerated for purposes of illustration.

Figure 2:
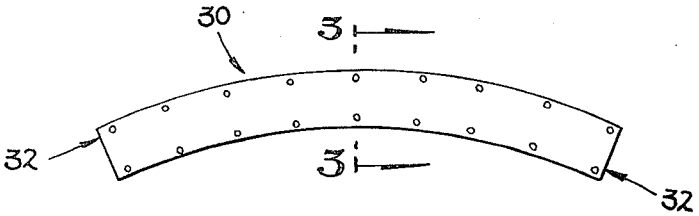
FIG. 2 shows a pre-cambered beam of the present invention intended to replace the wood beam of the prior art.
Figure 3:
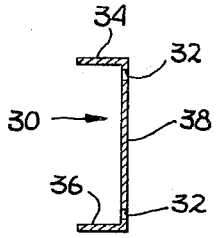
FIG. 3 is a cross-section of the beam of FIG. 2.

The pre-cambered beam of one embodiment of the present invention is shown in FIGS. 2 and 3, FIG. 2 being a side view and FIG. 3 a cross-section of the beam. The pre-cambered beam 30 is curved along its length as shown in exageration in FIG. 2 and is provided with a plurality of holes 32 generally arranged in a line paralleling the curvature of the beam 30. The pre-cambered beam 30 in cross-section shows a typical one of the holes 32, and comprises a first flange 34 and a second flange 36 integrally joined by a web 38.

Figure 4:
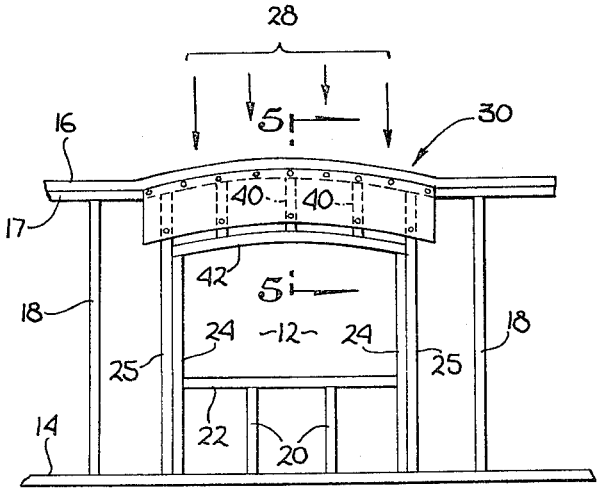
FIG. 4 shows the pre-cambered beam installed in the place of the wood beam shown in FIG. 1.
Figure 5:
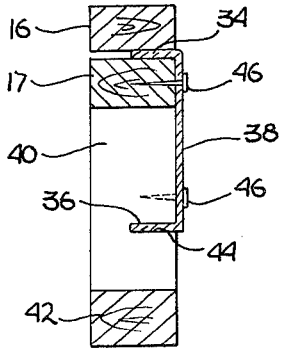
FIG. 5 is a cross-section taken along the line 5—5 of FIG. 4.

Such a beam may be installed as shown in FIGS. 4 and 5 to replace the large wooden header 26, shown in FIG. 1. This installation requires minor structural changes in the portion of the wood frame wall 10 defining the structure above the window opening 12. The plates 16 and 17 are now preferably curved slightly to conform to the curvature of the pre-cambered beam 30, though the minor extent of the curvature allows the curvature to be easily imposed during construction. As shown, preferably upper flange 34 of the pre-cambered beam 30 is located between plates 16 and 17. A plurality of cripple studs 40 join the curved portion of the plate 17 to a small header 42 which now spans the distance between the jack studs 24. The lower flange 36 of the beam 30 is located within saw kerfs 44 provided a given distance down the cripple studs 40. Beam 30 is secured in place by a plurality of nails 46, each passing through a respective hole 32 through the pre-cambered beam 30, anchoring the beam 30 to the plate 17 and cripple studs 40. This configuration is most clearly shown in the cross-sectional view of FIG. 5. The holes 32 may be preformed, or in some instances if the webbing 38 is sufficiently thin to be pierced by nails, may be omitted in favor of piercing at the time of nailing.

The structure of the pre-cambered beam 30 together with the plates 16,17, and cripple studs 40 and small header 42 has a number of advantages over the usual large wooden header 26 when installed as shown. The pre-cambered beam 30 of FIG. 4, when subjected to the loading indicated by arrows 28, will deflect immediately upon loading. This is to be contrasted with the gradual deflection of the large wooden header 26. Because the beam 30 is pre-cambered its deflection will merely cause the beam 30 to deflect to a substantially straight condition. After installation and construction is complete, assuming the proper amount of pre-camber was used, the pre-cambered beam 30 will only deflect to the straight condition, and because the pre-cambered beam is made of steel and will not creep over an extended period of time, no visible sag occurs or later develops.

The pre-cambered beam 30 is preferably formed by a roll forming process, using an apparatus functionally illustrated in FIG. 6. A length of sheet steel 50, having a longitudinal centerline 51, is passed through a plurality of rollers 52, which gradually form the sheet steel 50 into the desired cross-sectional shape. Once the desired cross-sectional shape has been achieved, such as at station 53 in FIG. 6, curvature may be provided to the now finally formed beam by passing the beam through a deflection guide 56. The deflection guide 56 has a longitudinal centerline 66 which is angularly displaced from the longitudinal centerline 51 of the sheet steel 50. This angular displacement is indicated as the angle alpha ($\alpha$) designated 68 in FIG. 6. Adjustment of the angle alpha 68 will vary the amount of curvature of pre-camber which is provided to the beam 30. The deflection guide 56 can, of course, be adjusted so that the angle alpha 68, as appears in FIG. 6, can occur to either side of the longitudinal centerline 51 of the sheet steel 50. Adjustment of the distance D, indicated as 70 in FIG. 6, which distance is the distance between the final roller 52 and the center of the deflection guide 56, also influences the amount of camber provided to the beam 30. Finally, it should also be noted that the deflection guide 56 may be rotated somewhat about a horizontal axis or about the longitudinal axis as may be required to assure the pre-camber is along the longitudinal axis. This may be particularly important for forming beams of non-symmetrical cross section. A cross-section of the deflection guide 56 is shown in FIG. 6*a*. The deflection guide 56 comprises a male portion having a base 58, a vertical support member 60, and a cap 62. These three elements define the male portion which conforms to the interior shape of the desired pre-cambered beam, such as beam 30. The deflection guide 56 also comprises a cover portion 64 defining the exterior shape of the beam, such as precambered beam 30.

FIGS. 7, 7*a* and 8 illustrate the progression of the cross-sectional shape of the sheet steel 50 as it progresses through the forming apparatus to become the pre-cambered beam 30. FIG. 7 is a side view of the sheet steel 50 as it progresses down the forming apparatus in the direction of the arrow 54. The cross-section of the steel sheet 50 at station 71, is indicated in FIG. 8 as 81. The cross-section at stations 72 through 77 are indicated in FIG. 8 as elements 82 through 87, respectively. It should be noted that the cross-section 84, taken at station 74, is the cross-section of the pre-cambered beam 30 shown in FIG. 3. At station 77, the final cross-sectional shape has been given to the steel sheet 50 and the formed beam is now ready for passing through the deflection guide 56 so that the desired amount of pre-cambering can be supplied to the beam. For purposes of providing a complete explanation, there is illustrated in FIG. *7a,* a cross-section of the steel sheet 50 as it passes over the male mold 78 and is formed into shape by rollers 52. At this point, the cross-sectional shape of the steel sheet 50 is the same as indicated in FIG. 8 as 83. As the steel sheet 50 moves along the apparatus in the direction of arrow 54 from station 73 towards 74, the next successive pair of rollers 52 gradually causes the steel sheet 50 to be bent into the cross-sectional shape shown as 84 in FIG. 8.

This method of forming the beam such as beam 30, may also be used to form steel beams which can be used in the steel construction industry. Such beams typically will include I beams and the cross-sectional shape of the steel sheet 50 indicated as 84 in FIG. 8. This C-shaped cross section can be further formed by successive rollers 52 to produce successive cross-sectional shapes 85, 86 and 87 so that the generally C-shaped cross-section is further provided with a pair of lips 88 and 89. A steel beam having the cross-sectional shape 87 can be used in conjunction with a second steel beam having a similar cross-sectional shape to form I beams.

If a first beam having the cross-sectional shape 87 is passed through the apparatus of FIG. 6, where the angle alpha 68 is to one side of the center line 51, a first pre-cambered beam will be formed, having a predetermined curvature. Such a beam 90 is shown in FIGS. 9 and 10. If a second beam, having the same cross-sectional shape 87 is similarly passed through the same apparatus of FIG. 6, a similarly shaped pre-cambered beam 100 will be formed. If these two pre-cambered beams 90 and 100 are then placed back-to-back, such that their web portions are in contact with one another, and if the first beam is rotated 180 degrees with respect to the second beam, the two beams as viewed, will have a curvature which makes the two beams congruent with one another. If, in this position the two beams are welded, bolted, screwed or otherwise fastened together at their webs, they will form a single I beam 110, as illustrated in FIG. 13 and in cross-section in FIG. 14. FIG. 9 illustrates the first beam formed as discussed above, where the flanges 92 and 94 extend to the right as viewed in FIG. 10. FIG. 11 illustrates the second of the two beams discussed above. The beam 100 has been rotated such that flanges 102 and 104 extend towards the left in FIG. 12 with web 106 joining them.

One of the primary advantages of beams such as pre-cambered beam 30 or pre-cambered I beam 110, is that when placed under load, the loading will deflect the beam to its substantially straight position. Thus, if such a beam is used in construction in locations such as at a roof line, the loading on the beam will deflect the beam so that the beam is substantially straight and the roof line then also will appear straight. In contrast, when a straight beam is used on a roof line and loaded, the straight beam will deflect and give the appearance of a sagging roof which gives the viewer the impression that the roof is not structurally sound. By using the pre-cambered I beams 110, or pre-cambered beams 30 of the present invention in such locations in steel structures such as 120 shown in FIG. 15, where the beams 122 or 124 are fitted in supporting a roof line, the curvature can be matched with the loading on the pre-cambered beam such that the loading will cause the pre-cambered beam to flex to its straight position (122' or 124'), thereby giving the appearance of a straight roof line. This not only pleases a viewer, but also gives the viewer the impressions that the structure is more structurally sound. It should be readily apparent that a larger beam and/or additional supporting truss work is necessary in the prior art, in order to withstand a given load without visible deflection than is required in the present invention to support the same load and yet allow a reasonable deflection for the beams. With this in mind, it can be seen that by using a pre-cambered beam such as 124, a lighter beam can be used to support the same load and still provide esthetically pleasing results, such as a straight roof line.

As shown in FIG. 15, these pre-cambered beams can be used not only at the roof line (such as 124), but also at points intermediate the roof line and the peak of the roof (such as 126), and such as intermediate the ends of other pre-cambered beams to support the lateral network of beams which are used in such structures to support the roofing material which may be galvanized sheet steel or other shell-type roofing material. It should be kept in mind that in the various figures herein, the degree of curvature has been exaggerated for purposes of illustration and the amount of pre-camber provided to the beams actually used in the industry will depend, to a great extent, on the degree of loading required.

Figure 18:
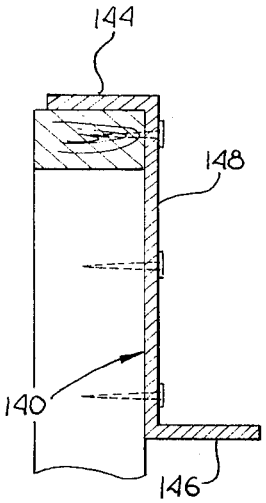
FIG. 18 illustrates another alternate cross section of a pre-cambered beam.
Figure 16:
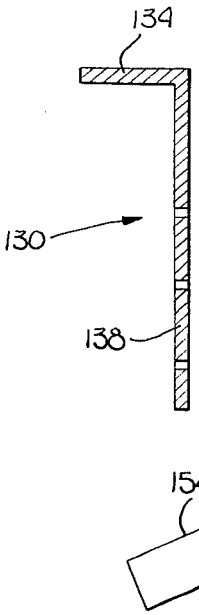
FIG. 16 illustrates a pre-cambered beam of alternate cross section.
Figure 17:
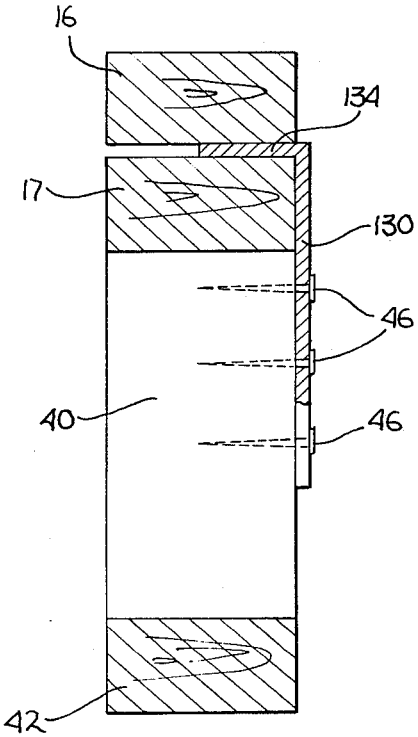
FIG. 17 illustrates a cross section of the installed beam of FIG. 16.

Additional cross-sectional shapes of the beam of the present invention are shown in FIGS. 16 through 18.

The L-shaped beam 130 of FIG. 16 is very similar to the beam 30 of FIGS. 2 through 5. It is pre-cambered and provided with a web 138 and a single flange 134 compared to the two flanges 34 and 36 of beam 30. When beam 130 is installed as shown in FIG. 17, no kerf 44 is used. Rather, the beam 130 is secured in place by a sufficient number of nails 46.

The Z-shaped beam 140 of FIG. 18 is also provided with a degree of pre-camber. Such a beam may typically have a first flange 144 and a second flange 146 attached to opposite sides of web 148 and extending therefrom on opposite sides. The Z-shaped beam 140 is typically installed on a header plate 17 having cripple studs 27 similar to those illustrated in FIG. 1.

While the pre-cambered beams of the present invention and the one method for making the same have been described herein with reference to FIGS. 1 through 18, and the preferred embodiments illustrated therein, it must be kept in mind that various changes and modifications in details of manufacture as well as materials can be made to the present invention by one of ordinary skill in the art without departing from the spirit and scope of the invention.

Figure 19:
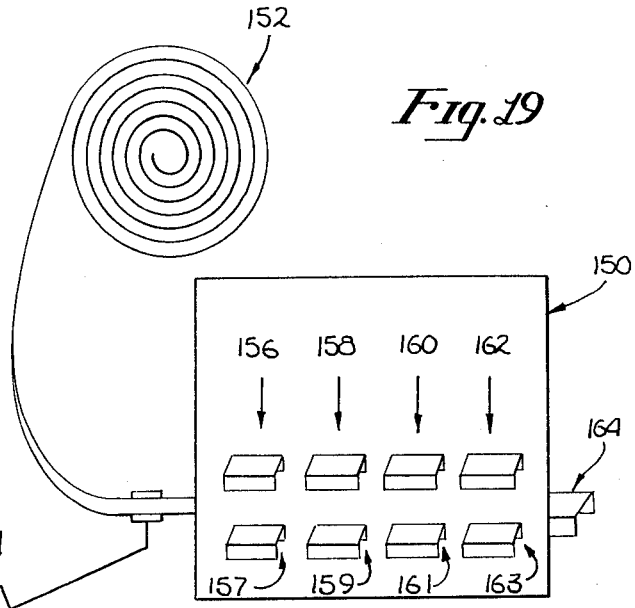
FIG. 19 shows an alternate method for forming the cross section of the beam.

For example, the precambered beam may be given the desired cross sectional shape by use of a multi-station punch press machine 150 as functionally illustrated in FIG. 19. A roll 152 of sheet metal is fed into the punch press 150 by a pneumatic hand and feeder mechanism 154. Within the punch press 150 are a plurality of stations such as stations 156, 158, 160 and 162 at each of which a pair of dies 157, 159, 161 and 163 respectively are operated by the punch press machine 150 to gradually stamp the sheet steel into the desired cross section.

The first die set 157 stamps the sheet steel and slightly changes its shape, the second die set 159 stamps the sheet steel and changes the shape slightly more. The last die set 163 gives the sheet steel its final cross sectional shape as shown at 164. The precamber may be supplied by a deflection guide 56 as described above, by cambering the dies with respect to each other in the progression, by stamping so as to spank one side of the beam harder than the other, and/or by alternate methods such as illustrated in FIGS. 20 and 21.

Figure 20:
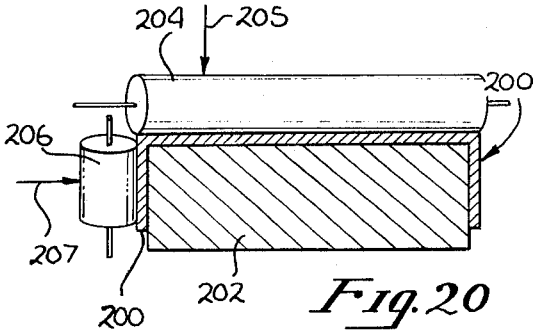
FIG. 20 shows a first alternate method of providing precamber to a beam.

FIG. 20 shows the beam 200, after it is formed to its final cross section, with a portion of the beam 200 positioned between a fixed rigid backing member 202 and a pair of rollers 204 and 206 applying substantial pressure to the beam. The pressure exerted by roller 204 is concentrated at that end of the roller 204 which is adjacent the side of beam 200 which is desired to be extruded. Thus as shown in FIG. 20 roller 204 applies pressure toward its left end indicated by arrow 205, and roller 206 applies pressure indicated by arrow 207. The pressure thus applied tends to cause the beam 200 to extrude slightly on that one side only. This extrusion tends to lengthen that side of the beam 200 and induce camber. By controlling the degree of extrusion (amount of pressure) the degree of camber may be controlled.

Figure 21:
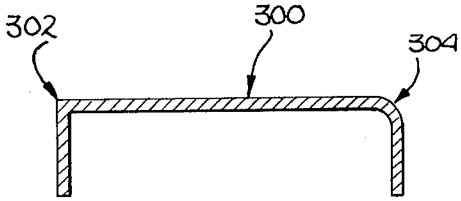
FIG. 21 shows a second alternate method of providing pre-camber to the beam.

Camber may also be induced to a beam 300 having two bends, such as 302 and 304 shown in FIG. 21, by forming one bend more rapidly and/or sharper than the other. The more rapidly formed bend will tend to stretch the flange at that bend and thus induce camber. This method also produces camber where only one bend is formed if that bend is produced rapidly enough. With this method, the degree of camber is more difficult to control, but is known to be dependent upon the rapidity with which the beam changes from flat to fully formed. If the bend is formed within a sufficiently short distance the stresses induced in the flange stretch the metal in the flange thus producing camber in the finished beam.

Figure 22:
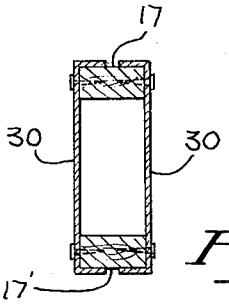
FIG. 22 shows installation of precambered beams according to the present invention, in pairs.

While the above discussed figures show the typical installation of a single precambered beam, it is contemplated that precambered beams may be installed in pairs as shown in FIG. 22. In that Figure, two beams 30 such as shown in FIGS. 2 and 3 are secured to a first plate 17 and a second plate 17' such as by nails (not shown). In such a configuration, depending on physical dimension (e.g., distance between 17 and 17'), the cripple studs 27 (as in FIG. 1) may be omitted. The structure of FIG. 22 may serve as an alternate construction for a header beam such as shown in FIG. 5.

The various figures are provided merely for purposes of illustration and discussion of the various forms of the invention and should not be interpreted as limiting the invention in any way. The scope of the present invention is intended to be defined only by the appended claims.

What is claimed is:

1. In wood frame construction, a composite load bearing structure, comprising:

a metal beam element formed to have a cross section which includes a substantially flat web and at least one flange generally perpendicular to said web, said beam element having a predetermined precamber along its longitudinal axis and parallel to said web when not subjected to a load;

a wood frame construction element spanning a length over which a load is to be supported, said wood frame construction element being initially bowed in a direction opposite the deflection said load would produce and in an amount substantially equal to said precamber of said metal beam element;

said wood frame construction element being disposed to abut both said first flange and said web along their length such that said precamber of said metal beam element is substantially coincident with said bow in said wood frame construction element, the amount of said precamber being predetermined so that said composite load bearing structure will deflect to a substantially straight and uncambered condition under the intended load; and fastening means for fastening said metal beam element to said wood frame construction element.

2. The composite load bearing structure of claim 1 wherein said metal beam element is formed by a roll forming process and said pre-camber is imparted after said roll forming process.

3. The composite load bearing structure of claim 1 wherein said metal beam element is precambered with said flange disposed toward the outside of the curve of the precamber, whereby said flange and part of said web abutting said wood frame construction element are loaded in compression when under the intended load.

4. The composite load bearing structure of claim 1, wherein the cross-section of said element further comprises a second flange affixed perpendicular to said web and parallel to said first flange.

5. The composite load bearing structure of claim 4 further comprising:

a plurality of substantially equal length wood cripple studs, each joined at one end to said wood frame construction element and to said web by said fastening means, whereby the cripple studs extend substantially perpendicular to said wood frame construction member and are joined at the other end to a wooden beam extending substantially perpendicular thereto, each of said studs being provided with a saw kerf for receiving said second flange.

6. The composite load bearing structure of claim 4 wherein said web and said first and second flange comprise a "Z" shaped cross-section.

7. The composite load bearing structure of claim 4 wherein said web and said first and second flange comprise a channel cross-section.

8. The composite load bearing structure of claim 1 wherein said wood frame construction element is a top plate.

9. The composite load bearing structure of claim 3 wherein said metal beam element is fastened to said wood frame construction element by nailing through prepunched holes in said metal beam element.

10. The composite load bearing structure of claim 9 wherein said flange and said flat web comprise an "L" shaped cross-section.

11. In wood frame construction a load bearing structure for spanning window and door breakouts and the like comprising:

a bottom plate;

at least one top plate;

a plurality of studs extending vertically between and being fastened to said top and bottom plates, at least one king stud being located at each side of the desired breakout;

a header extending between said king studs defining the top of said breakout;

at least one partial stud extending between and being fastened to said header and said top plate;

a metal beam element formed to have a cross-section which includes a substantially flat web, said beam element having a predetermined precamber along its longitudinal axis and parallel to said web; and said web of said beam element being fastened to said at least one top plate and said at least one partial stud, and to each of said king studs so as to retain said top plate and said header in a bowed condition, conforming to the precamber of said beam element, prior to loading.

12. The load bearing structure of claim 11 wherein said metal beam element is fastened to said top plate, at least one partial stud and to said king studs by nailing through prepunched holes in said metal beam element.

13. The load bearing structure of claim 12 wherein said metal beam element has an "L" shaped cross-section.

14. The load bearing structure of claim 12 wherein said metal beam element has a channel cross-section.

15. The load bearing structure of claim 12 wherein said metal beam element has a Z-shaped cross-section.

16. In wood frame construction a load bearing structure for spanning window and door breakouts and the like comprising:

a bottom plate;

at least one top plate;

a plurality of studs extending vertically between and being fastened to said top and bottom plates, at least one king stud being located at each side of the desired breakout;

a header extending between said king studs defining the top of said breakout;

a first metal beam element and a second metal beam element each formed to have a cross-section which includes a substantially flat web, each said beam element having a predetermined precamber along its longitudinal axis and parallel to said web;

said web of each said first and second beam element being fastened to a respective side of said at least one top plate and said header so as to retain said top plate and said header in a bowed condition, conforming to the precamber of said beam element, prior to loading.

17. The load bearing structure of claim 16 wherein each said metal beam element is fastened to said top plate, and to said header by nailing through prepunched holes in each said metal beam element.

18. The load bearing structure of claim 17 wherein each said metal beam element has an "L" shaped cross section.

19. The load bearing structure of claim 17 wherein each said metal beam element has a channel cross section.

20. The load bearing structure of claim 17 wherein each said metal beam element has a Z shaped cross section.

21. An arcuate precambered metal structural beam having a cross-section defined by a web and a flange generally perpendicular to said web;

a first wooden plate disposed to abut said first flange and said web along their length;

fastening means for securing said first wooden plate in its disposition;

a plurality of substantially equal length wood cripple studs each joined at one end to said first wooden plate and extending substantially perpendicular thereto; and each of said cripple studs joined at their other end to a beam and also joined to said web by fastening means.

22. An arcuate precambered metal structural beam having a generally C-shaped cross section defined by a web and a first and a second flange oriented generally perpendicular to the plane of said web;

a first wooden plate disposed to abut said first flange and said web along their length;

fastener means for securing said first wooden plate to said web;

a plurality of substantially equal length wood cripple studs each joined at one end to said first wooden plate and extending substantially perpendicular thereto;

fastener means for securing each cripple stud to said web;

each of said cripple studs joined at their opposite ends to a wooden beam, and provided intermediate their ends with a saw kerf for receiving said second flange.

* * * * *